US005878391A

United States Patent [19]

Aarts

[11] Patent Number: 5,878,391

[45] **Date of Patent: *Mar. 2, 1999**

[54] DEVICE FOR INDICATING A PROBABILITY THAT A RECEIVED SIGNAL IS A SPEECH SIGNAL

[75] Inventor: Ronaldus M. Aarts, Eindhoven, Netherlands

[73] Assignee: U.S. Philips Corporation, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 888,356

[22] Filed: Jul. 3, 1997

Related U.S. Application Data

[63] Continuation of Ser. No. 280,043, Jul. 25, 1994.

[30] Foreign Application Priority Data

Jul. 26, 1993 [BE] Belgium ..... 09300775

[51] Int. Cl.[6] ..... G10L 5/00

[52] U.S. Cl. ..... 704/233; 704/208; 704/206; 704/240

[58] Field of Search ..... 704/210, 215, 704/233, 200, 253, 208, 214, 206

[56] References Cited

U.S. PATENT DOCUMENTS

| | | | |
|---|---|---|---|
| 4,446,531 | 5/1984 | Tanaka | 395/2.48 |
| 4,624,011 | 11/1986 | Watanabe et al. | 395/2.48 |
| 4,720,862 | 1/1988 | Nakata et al. | 381/38 |
| 4,920,568 | 4/1990 | Kamiya et al. | 381/46 |
| 4,982,341 | 1/1991 | Laurent | 364/517 |
| 5,007,093 | 4/1991 | Thomson | 381/46 |
| 5,046,100 | 9/1991 | Thomson | 381/49 |
| 5,097,510 | 3/1992 | Graupe | 381/47 |
| 5,197,113 | 3/1993 | Mumolo | 704/200 |
| 5,323,337 | 6/1994 | Wilson et al. | 364/574 |
| 5,457,769 | 10/1995 | Valley | 395/2.19 |

OTHER PUBLICATIONS

Yang, "Frequency Domain Noise Suppression Approaches in Mobile Telephone Systems," Proc. of IEEE ICASSP 1993, vol. II, pp. 363–366, Apr. 1993.

*Primary Examiner*—David D. Knepper
*Attorney, Agent, or Firm*—Edward W. Goodman

[57] ABSTRACT

A probability indication signal $V_P$ indicates the probability that the audio signal received via the input is a speech signal. An analyzing circuit derives (NA) which is indicative of the ratio between a signal power in a first portion of a frequency spectrum of the received signal and a signal power in a second portion of the frequency spectrum. A signal pattern detector detects signal patterns in the analysis signal (NA) in another signal, for example, a music signal. An estimator derives the probability indication signal $V_P$ in dependence on the detected signal patterns.

10 Claims, 4 Drawing Sheets

DEVICE FOR INDICATING A PROBABILITY THAT A RECEIVED SIGNAL IS A SPEECH SIGNAL

This is a continuation division of application Ser. No. 08/280,043, filed Jul. 25, 1994.

BACKGROUND OF THE INVENTION

1. Field Of The Invention

The invention relates to a speech signal discrimination arrangement having an input for receiving an audio signal and an output for supplying a probability indication signal which is indicative of the probability that the audio signal received via the input is a speech signal.

The invention further relates to an audio device including such a speech signal discrimination arrangement.

2. Description Of The Related Art

A speech signal discrimination arrangement and an audio device of the types defined above are known from Rundfunktechnische Mitteilungen; Band 12; 1968, Heft 6, pp. 288–291. The known speech signal discrimination arrangement is adapted to discriminate speech signals from music signals in a radio receiver. When a speech signal is detected, the received signal is processed to improve the intelligibility of the reproduced speech signal. When a music signal is detected the received signal is subjected to processing which is particularly suitable for use in the case of the reception of music signals.

The known speech signal discrimination arrangement utilizes the fact that the amplitude of music signals, in general decreases gradually whereas the amplitude of speech signals, in general decreases abruptly. These gradual decreases are detected and a signal producing, containing a pulse upon each detection, is integrated. This integrated signal indicates whether the received audio signal is a speech signal or a music signal. A drawback of the known discrimination arrangement is that in a comparatively large number of cases (3%), the integrated signal does not provide a correct indication of the type (music or speech) of audio signal received.

SUMMARY OF THE INVENTION

It is an object of the invention to provide a speech signal discrimination arrangement which enables a more reliable discrimination between speech signals and music signals to be obtained.

According to the invention, this object is achieved by means of a speech signal discrimination arrangement which is characterized by an analyzing circuit for deriving an analysis signal which is indicative of the ratio between a signal power in a first portion of a frequency spectrum of the received signal, and a signal power in a second portion of the frequency spectrum, a signal pattern detector for detecting signal patterns in the analysis signal having a probability of occurrence in a speech signal that differs from a probability of occurrence in another signal not being a speech signal, and estimator means for deriving the probability indication signal in dependence upon the detection of the signal patterns.

The invention is based on the recognition of the fact that variation patterns in the ratio between signal powers in different parts of the spectrum for speech signals differ distinctly from the patterns for other signals. In the arrangement in accordance with the invention, the probability signal is derived taking into account time domain aspects as well as frequency domain aspects, which increases the reliability of the derivation.

The arrangement in accordance with the invention further has the advantage that the strength of the received signal hardly affects the probability signal. This is the result of the fact that the probability signal is derived from the ratio between signal powers, this power ratio not depending on the strength of the received signal.

It is to be noted that European Patent Application EP-A-0,398,180 U.S. Pat. No. 5,197,113, describes a discrimination arrangement which utilizes the ratio between the signal powers in different parts of the spectrum for the purpose of signal discrimination. However, this arrangement discriminates between voiced and non-voiced signal portions in a speech signal and does not discriminate between the speech signal itself and another signal.

Characteristic of speech signals are rapid variations in the power ratio which appear briefly in succession. Another characteristic feature of speech signals is a brief temporary decrease of the power ratio. In principle, the characteristic patterns of speech signals are not limited to these patterns. However, these patterns have the advantage that they can be detected simply.

The probability signal can be based on detections of one type of characteristic patterns. However, the reliability is increased considerably if two or more types of characteristic patterns are used for the derivation.

BRIEF DESCRIPTION OF THE DRAWINGS

The invention will now be described in more detail hereinafter with reference to FIGS. 1 to 9, in which.

DESCRIPTION OF THE PREFERRED EMBODIMENTS

Figure 1:
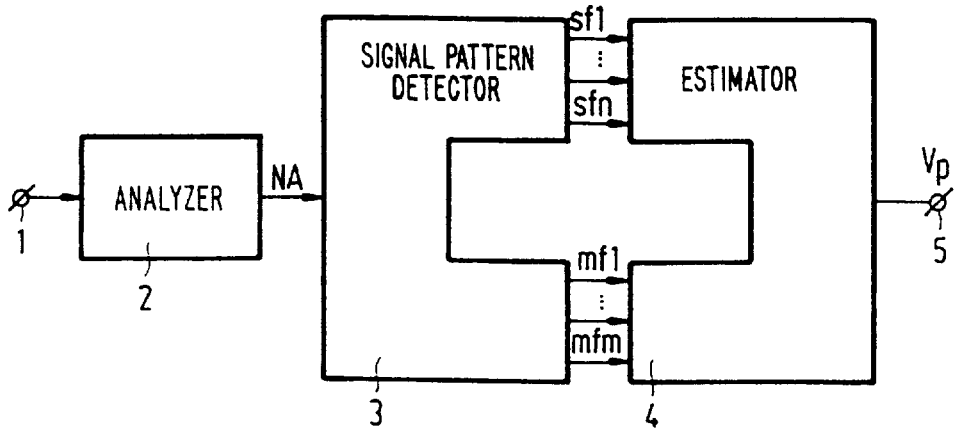
FIG. 1 shows an embodiment of a speech signal discrimination arrangement in accordance with the invention.

FIG. 1 shows a speech signal discrimination arrangement in accordance with the invention. The arrangement has an input 1 for receiving an audio signal. The audio signal received via the input 1 is applied to an analyzing circuit 2. The analyzing circuit 2 derives, from the received audio signal, an analysis signal NA which is indicative of the ratio between a signal power in a first portion of a frequency spectrum of the received signal and a signal power in a second portion of the frequency spectrum.

The first portion of the frequency spectrum comprises the frequency range in which the frequency components of a speech signal are concentrated. A suitable lower limit and a suitable upper limit are, for example, 70 Hz and 700 Hz, respectively. The second portion comprises a part of the audio spectrum which contains comparatively few frequency components occurring in a speech signal.

Figure 2:
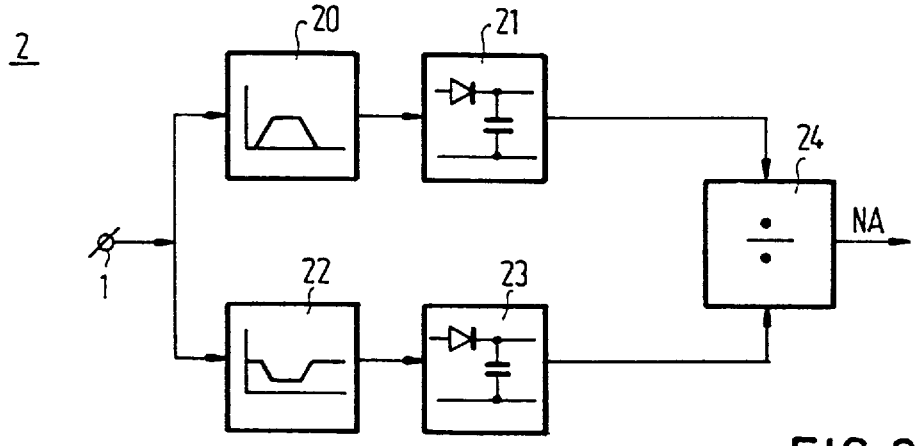
FIG. 2 shows an analyzing circuit for use in the speech signal discrimination arrangement.

A suitable frequency range is the entire audio spectrum minus a frequency range between 130 to 1200 Hz. FIG. 2 shows an example of the analyzing circuit 2, which derives an analysis signal which is indicative of the ratio between the signal power of frequency components between 70 and 700 Hz and the signal power of the frequency components of the audio signal outside the frequency range between 130 and 1200 Hz. The analyzing circuit 2 shown in FIG. 2 comprises a band-pass filter 20 having a pass band from 70 to 700 Hz. The filter 20 has an input connected to the input 1 for receiving the audio signal. The audio signal filtered by the filter 20 is applied to a detector 21 via an output of the filter 20 in order to determine a signal power of this filtered signal.

The analyzing circuit shown in FIG. 2 further comprises a filter 22 having a so-called bathtub-shaped frequency response curve, which provides a boost of the frequencies outside the frequency range between 130 and 1200 Hz. The filter 22 has an input connected to the input 1. The signal filtered by the filter 22 is applied to a detector 23 via an output of the filter 22 to determine a signal power of this filtered signal. A circuit 24 of a customary type derives from the output signals of the detectors 21 and 23, the ratio between the signal power determined by the detector 21 and the signal power determined by the detector 23. The analysis signal NA indicating this power ratio is supplied via an output of the circuit 24.

It is to be noted that the example shown in FIG. 2 is only one of the many possible examples of the circuit for deriving the analysis signal. For possible alternatives, reference is made to, for example, the afore-mentioned European Patent Application EP-A 0,398,180.

Figure 3:
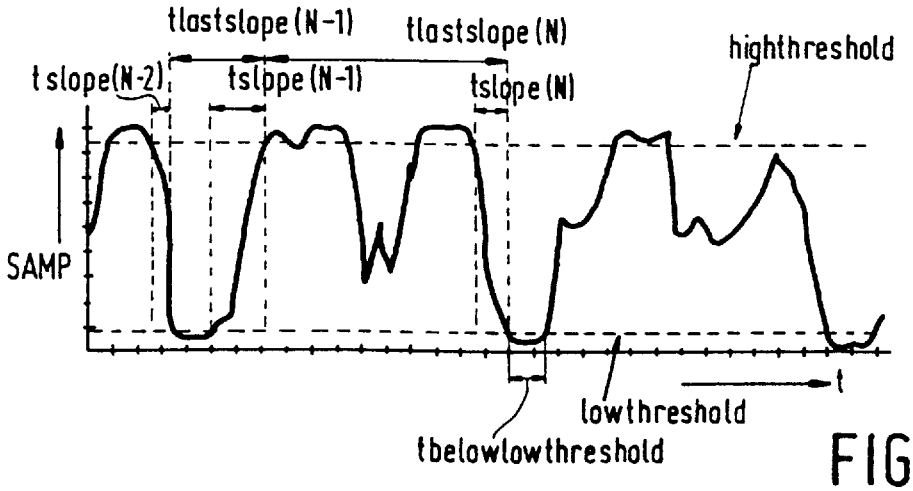
FIG. 3 shows a possible waveform of an analysis signal supplied by the analyzing circuit.

FIG. 3, by way of illustration, shows the variation of the power ratio (SAMP) indicated by the analysis signal NA supplied by the circuit 24. If all the frequency components of the audio signal are situated within the bandwidth of the filter 20, as is often the case with a speech signal, the power ratio will be maximal. The value of this maximum depends on the extent to which these frequency components are transmitted by the filter 22.

If the audio signal has many frequency components outside the bandwidth of the filter 20, as is generally the case with music signals, the power ratio will decrease to a small value. It is to be noted that also in the case of speech signals, particularly so-called fricatives, wide-band signals occur for which the power ratio is small, so that on the basis of this power ratio, no reliable decision can be taken about the nature of the received audio signal.

Power ratio patterns which are characteristic of speech signals are patterns in which a number of briefly succeeding rapid changes in the power ratio occur. The probability that the relevant audio signal is a speech signal increases as this number increases. A rapid change in the power ratio is to be understood to mean that within a given time, the value of the power ratio changes from a value above an upper threshold to a value below a lower threshold or vice versa. Another characteristic feature of speech signals is a temporary decrease of the power ratio caused by the short breaks preceding plosives or by short fricatives. It is to be noted that the power ratio patterns which are characteristic of speech are not limited to the two afore-mentioned patterns. However, these two patterns have the advantage that they can be detected by simple means.

Characteristic of music signals are, for example, long sustained tones, causing, for example, a low ratio for a longer time. Very high pitched tones and very low pitched tones causing an extremely low ratio are also characteristic of music signals. It will be obvious to those skilled in the art that the patterns which are characteristic of music are not limited to the afore-mentioned patterns.

The reference numeral 3 in FIG. 1 refers to a signal pattern detector which detects characteristic patterns, for example speech-characteristic patterns having a probability of occurrence in speech signals that differs from a probability of occurrence in another signal not being a speech signal, for example, a music signal.

The signal pattern detector 3 supplies detection signals sfl, . . . ,sfn to an estimator circuit 4, these detection signals indicating that a pattern has been detected is more likely to occur in speech signals than in other signals.

If desired, the signal pattern detector 3 may be adapted to detect music-characteristic patterns in addition to speech-characteristic patterns. Detection signals mfl, . . . , mfm are then also applied to the estimator circuit 4, these detection signals indicating that a pattern has been detected is more likely to occur in music signals than in other signals.

The estimator circuit 4 derives a probability indication signal $V_p$ in dependence on one or more of the detection signals sfl, . . . ,sfn and mfl, . . . ,mfm, this indication signal being indicative of the probability that the audio signal received at the input 1 is a speech signal. The probability indication signal $V_p$ is supplied via an output 5. A suitable criterion for deriving the probability indication signal $V_p$ can be, for example, a criterion providing a distinct relationship between the frequency of detection of speech-characteristic and/or music-characteristic phenomena. Thus, it is possible, for example, to determine, each time in successive time intervals, the difference between the number of detected speech-characteristic patterns and the number of music-characteristic patterns. Different weighting factors may then be allocated to patterns of different types. Besides, it is to be noted that the reliability of the probability indication signal $V_p$ increases as a larger number of different types of characteristic patterns are detected. However, in principle, it is adequate to detect characteristic patterns of one type.

Moreover, it is to be noted that the derivation of the probability indication signal $V_p$ on the basis of detections of characteristic patterns in the analysis signal can also be effected on the basis of detections of characteristic patterns in the analysis signal as well as detections of characteristic phenomena in the audio signal itself, for example, as described in the above-mentioned article in Rundfunktechnische Mitteilungen.

Figure 4:
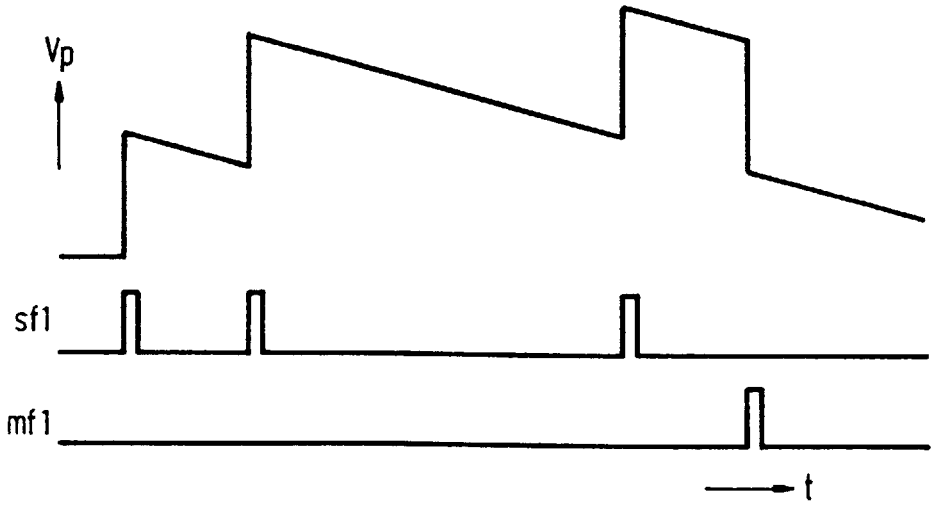
FIG. 4 and FIG. 5 show possible relationships between detection signals supplied by a signal pattern detector and a probability signal.

Another suitable criterion for deriving the probability signal $V_P$ will be described in more detail with reference to FIG. 4. This figure shows a detection signal sf1 and a detection signal mfl and an associated probability indication signal $V_P$ as a function of the time t. Each pulse in the detection signal sfl indicates that a speech-characteristic pattern of a given type has been detected in the ratio between the powers. Each pulse in the signal mfl indicates that a music-characteristic pattern of a given type has been detected in the power ratio.

In deriving the probability signal $V_P$, the value of the probability signal $V_P$ is incremented by a given first value in response to each pulse in the detection signal sf1. In response to each pulse in the detection signal mfl, the value of the probability signal $V_p$ is decremented by a given second value. In the present example, the second value is equal to the first value. It will be evident that the first and the second value need not be equal to one another. In the present example, it has been assumed that the number of detectable speech-characteristic patterns in the power ratio which occurs per unit of time during reception of a speech signal, is larger than the number of detectable music-characteristic patterns in the power ratio which occurs per unit of time during reception of a speech signal. In order to compensate for this, the value of the probability signal $V_P$ decreases gradually in the absence of pulses in the detection signals.

If a large number of speech-characteristic patterns and no or hardly any music-characteristic patterns are detected in the power ratio, it may be assumed that the probability that the received signal is a speech signal is high. In that case, the value of the probability signal $V_P$ will be high. Conversely, in the absence of speech-characteristic patterns in the power ratio, the probability that the received audio signal is a speech signal will be low. In that case, the value of the probability signal $V_P$ will be small. Consequently, the signal $V_P$ is indicative of the probability that the received audio signal is a speech signal. In the case that the reception of a speech signal for which a very large number of speech-characteristic patterns are detected is followed by the reception of a music signal, it may take a substantial time for the probability signal $V_P$ to reach a value corresponding to the received music signal. This can be precluded by limiting the maximum value of the probability signal $V_P$. For similar reasons it is also advantageous to limit the minimum value of the probability signal $V_P$.

Figure 5:
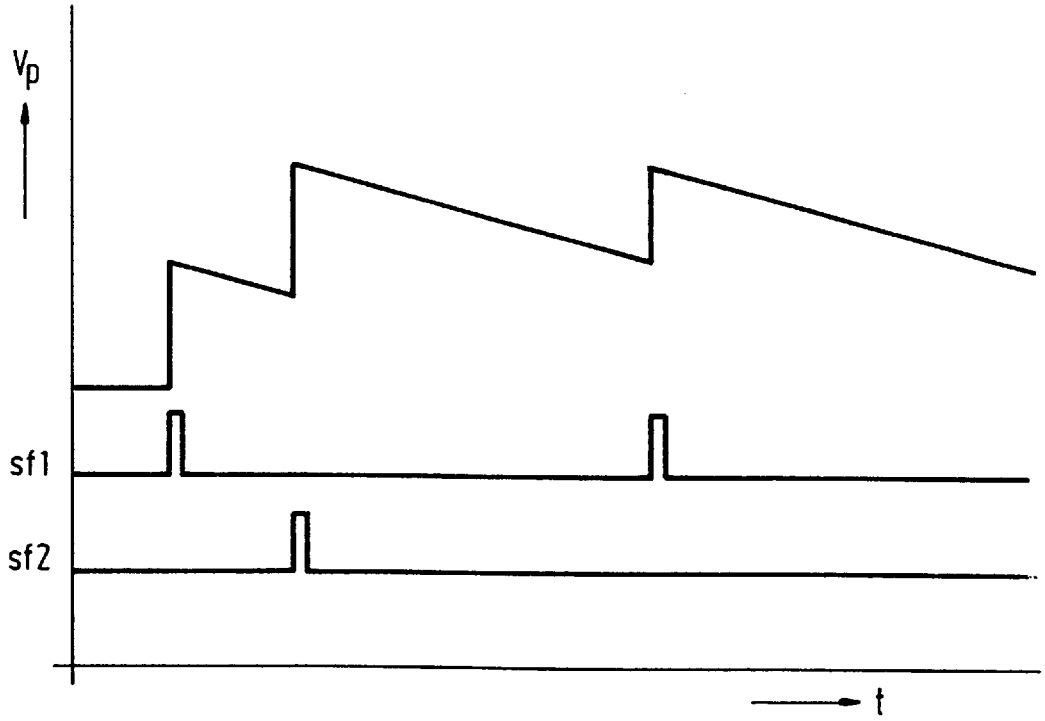

FIG. 5 shows the variation of the probability signal $V_P$ in the case that the value of the probability signal $V_P$ is incremented in response to pulses in a detection signal indicating detections of a speech-characteristic patterns of a first type and in response to pulses in a detection signal sf2 indicating detections of a speech-characteristic patterns of a second type.

It is to be noted that if the level of the power detected by the detectors 21 and 23 is low, the resulting power ratio is not always reliable. Therefore, it is advantageous to interrupt the pattern detection and the derivation of the probability signal $V_P$ during the time intervals in which said detected powers are small.

The signal pattern detector 3 and the estimator circuit 4 may be constructed as so-called hard-wired circuits.

It is also possible to construct the signal pattern detector and the estimator circuit by means of a so-called program-controlled circuit, for example, a microcomputer loaded with a suitable program.

Figure 6:
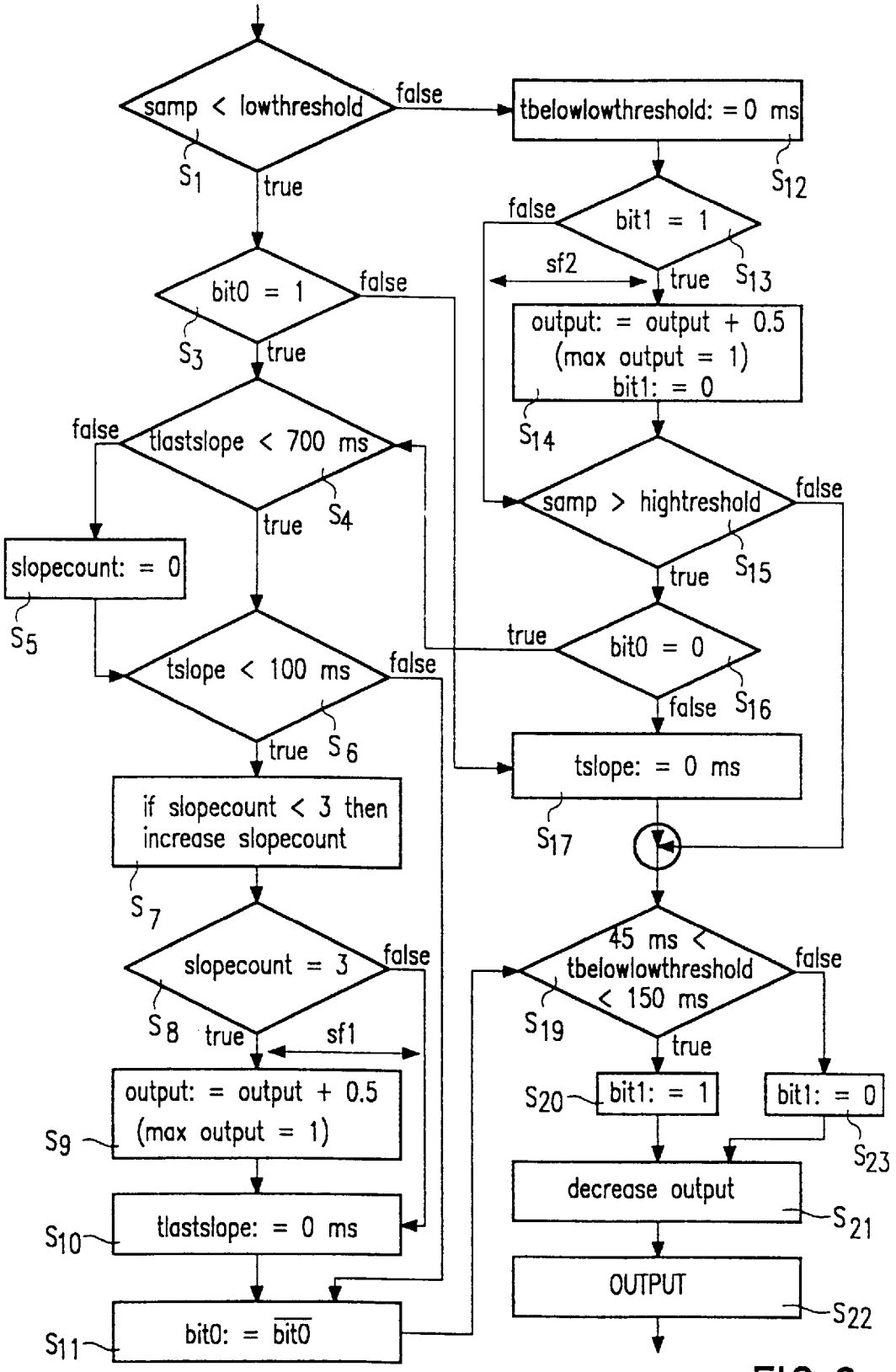
FIG. 6 shows a flowchart of a program carried out in an embodiment of the speech signal discrimination arrangement.

By way of example FIG. 6 shows a flowchart of a program for the detection of two different speech-characteristic patterns, and the derivation of the signal $V_P$ in a manner corresponding to the relationship between the detections and the signal $V_P$ illustrated in FIG. 5.

The detected speech-characteristic patterns comprise a sequence of three fast transitions in the power ratio, the time interval between consecutive transitions not being more than 700 ms. A fast transition is to be understood to mean a change of the power ratio such that the value of the power ratio changes from a value below a lower threshold (near the minimum value of the power ratio) to a value above an upper threshold (near the maximum value of the power ratio) or vice versa within 100 ms. In FIG. 3, the lower threshold and the upper threshold are marked "lowthreshold" and "highthreshold", respectively.

The second speech-characteristic pattern in the power ratio which is detected is a temporary reduction of the power ratio to a value below the lower threshold, this reduction having a length between 45 and 150 ms. To detect the speech-characteristic patterns, the program determines the values of a number of variables, i.e.

—"samp"; this is the value of the instantaneous power ratio.

—"tbelowlowthreshold"; this is the time that the power ratio is below the "lowthreshold";

—"tlastslope"; this is the time which has elapsed since the last detected fast transition;

—"tslope"; this is the length of a transition from a value below the low threshold to a value above the high threshold, or vice versa;

—"output"; this is the value of the probability signal;

—"slopecount" this variable indicates the number of fast transitions which are spaced by time intervals not longer than 700 ms;

—"bit0"; this is a logic variable which indicates whether the last threshold value exceeded by the power ratio is the lower threshold or the upper threshold.

—"bit1"; this is a logic variable which indicates whether "tbelowlowthreshold" is between 45 and 150 ms; and —"output"; This variable indicates the value of the signal $V_P$ By way of illustration, FIG. 3 gives the values of the variables "samp", "tlastslope", "tslope" and "tbelowlowthreshold" for a variation of the power ratio ("samp") in which both detectable patterns occur.

The program represented by the flowchart (FIG. 6) is called repeatedly at constant intervals.

For determining the values of the variables "tbelowlowthreshold", "tlastslope" and "tslope" the program may include so-called software timers, which can be reset to zero under program control and which each time, indicate the time which has expired since the last zero reset.

The program comprises a number of steps which are carried out in the sequence defined by the flowchart in FIG. 6.

In step S1, it is checked whether "samp" has a value below "lowthreshold".

In step S2, "tbelowlowthreshold" is reset to zero.

In step S3, it is ascertained whether the logic value of "bit0" is "1".

In step S4, it is checked whether "tlastslope" is smaller than 700 ms.

In step S5, "slopecount" is reset to zero.

In step S6, it is checked whether "tslope" is smaller than 100 ms.

In step S7, "slopecount" is incremented by one in the case that this variable is smaller than three.

In step S8, it is checked whether the value of "slopecount" is three.

In step S9, and step S14, the value of "output" is incremented by 0.5, the maximum value of "output" being limited to one. Moreover, the logic value of "bit1" is set to "0" in step S14.

In step S10, and step S17, "tslope" is set to zero.

In step S11, the value of "bit0" is inverted.

In step S12, "tbelowlowthreshold" is set to zero.

In step S13, it is checked whether the logic value of "bit1" is "1".

In S15, it is checked whether the value of "samp" is above the value of "highthreshold".

In step S16, it is checked if the logic value of "bit0" is "0".

In step S19, it is checked whether "tbelowlowthreshold" is between 45 and 150 ms.

In Step 20, the value of "bit1" is set to "1".

In step S21, the value of "output" is decremented by a small value if the minimum (O') for "output" has not yet been reached.

In step S22, the value of "output" is fed out.

In step S23, the logic value of "bit1" is set to "0".

The program proceeds as follows:

If the value of "samp" is below "lowthreshold" and "bit0" indicates that the last but one threshold crossing was a crossing of "highthreshold", this means that there has been a transition from above the upper threshold to below the lower threshold. In that case, the program proceeds to step S4 via steps S1 and S3.

If "samp" is above "highthreshold" and "bit0" indicates that the last but one threshold crossing was a crossing of "lowthreshold" this means that there has been a transition from below the lower threshold to above the upper threshold. In that case, the program also proceeds to the step S4 via the steps S1, S15 en S16. After the step S4 has been reached, the program section including the steps S4, S5, S6, S7, S8, S9, S10 and S11 is completed.

In this program section, it is ascertained whether the last transition was more than 700 ms ago (step S4). Moreover, it is checked whether the detected transition has occurred within 100 ms (step S6). Finally, it is checked if the number of successive transitions is three (step S8). If all these requirements are met, the variation of the power ratio exhibits a speech-characteristic pattern and the value of "output" is incremented by 0.5 (step S9). In addition, the value of "tlastslope" is set to zero (step S10). Moreover, in the case that it has been found in step S4 that the last transition has occurred longer than 700 ms ago, the value of "slopecount" is reset to zero during the step S5.

In the case that the detected transition (marked "tslope" ) is smaller than 100 ms, the value of "slopecount" is incremented by one in the step S7.

Moreover, each time that the program section is carried out, the value of "bit0" is inverted in step S11 in order to indicate that the direction of the next transition to be detected has been reversed. When the above program section is left, the program proceeds with the step S19.

If "samp" is below the lower threshold and "bit0" indicates that the last but one threshold crossing was a crossing of the lower threshold, the program proceeds to the step S19 via the steps S1, S3 and the step S17. In that case, there is no transition and the value of "tslope" is set to zero (S17). This also applies to a combination for which "samp" exceeds the upper threshold and, at the same time, "bit1" indicates that the last but one threshold crossing has been a crossing of the upper threshold. The program then proceeds to S19 via the steps S1, S15, S16 and S17.

After the step S19 has been reached, the program section which starts with the step S19 and ends with the step S22 is carried out. In this program section, it is checked (S19) whether the value "tbelowlowthreshold", which indicates the time that "samp" is below the lower threshold, is between 45 and 150 ms. If this is the case "bit1" is set to "1" (S20), and if this is not the case, "bit1" is set to "O0". Moreover, the value of "output" is decremented (S21) and the value of "output" is supplied as the probability signal.

Figure 7:
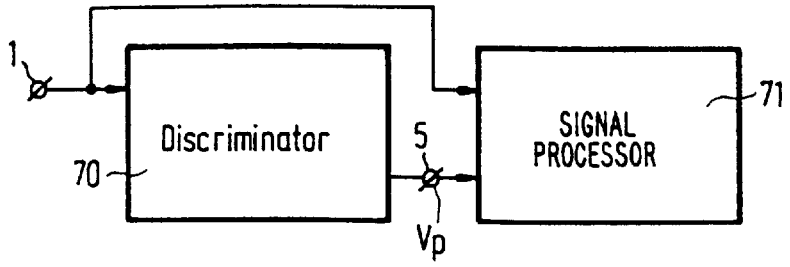
FIG. 7 shows an embodiment of an audio device using a speech signal discrimination arrangement in accordance with the invention.

If now, after the value of "samp" has been below the lower threshold for some time, the lower threshold is overstepped again during the step S12, the value of "tbelowlowthreshold" will be reset to zero. Subsequently, on the basis of the value of "bit1 ", it is ascertained in step S13, whether the final value of "tbelowlowthreshold" was between 45 and 150 ms just before the zero reset. If this is the case the variation of the power ratio will exhibit a speech-characteristic pattern and the next time that the step S13 is reached the step S14 will be carried out. The value of "output" is then incremented by 0.5 in the step S14. As already explained, the value of the probability signal $V_P$ indicates the probability that an audio signal received at the input 1 is a speech signal. FIG. 7 shows an audio device in accordance with the invention which employs a speech signal discrimination arrangement of the type defined described above bearing the reference numeral 70. The reference numeral 71 relates to an audio signal processing circuit by means of which the audio signal received at the input 1 is processed in a manner which depends on the signal value of the probability signal $V_P$.

Figure 8:
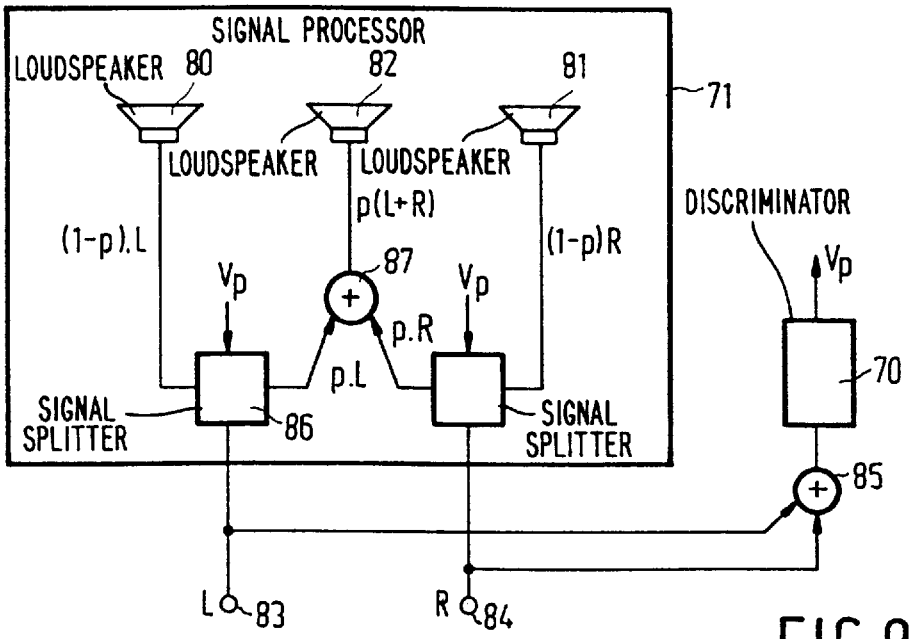
FIG. 8 and FIG. 9 show examples of an audio processing circuit for use in combination with the speech signal discrimination arrangement.

FIG. 8 shows an example of the audio signal processing circuit 71 in the form of a three-channel audio reproducing device, for example, for use in combination with a picture display unit such as a television set. The device comprises a first loudspeaker 80 for reproducing a left-channel signal, a second loudspeaker 81 for reproducing a right-channel signal and a third loudspeaker 82 for reproducing a center channel. When used in combination with a picture display unit, the left-channel loudspeaker 80 is arranged at the left of the picture display unit. The right-channel loudspeaker 81 is placed at the right of the picture display unit. The position of the centre-channel loudspeaker 82 is such that the direction of the reproduced sound corresponds to the location of the displayed picture. A left-channel signal L and a right-channel signal R of a stereo audio signal are applied to the circuit 71 via input terminals 83 and 84, respectively. Moreover, the left-channel signal L and the right-channel signal R are added in an adding circuit 85 and are subsequently applied to the speech signal discriminator 70.

The circuit 71 comprises a signal splitter 86, to which the left-channel signal L and the probability signal $V_P$ are applied. The signal splitter 86 is of a type which splits the received signal into two signals, one having a signal strength equal to p times the signal strength of the left-channel signal L and one having a signal strength equal to (1−p) times the signal strength of the left-channel signal, p being the probability, as represented by the probability signal, that the received signals are speech signals.

The signal having a strength of (1−p) times the strength of the signal L is applied to the loudspeaker 80. The signal having a strength of p times the strength of the signal L is applied to the adding circuit.

In the same way as the left-channel signal L, the right-channel signal R is split into a signal having a strength equal to p times the strength of the signal R, which signal is applied to the adding circuit 87, and into a signal having a strength equal to (1−p) times the strength of the signal R, which signal is applied to the loudspeaker 81. An output signal of the adding circuit 87, which is the sum of the signals applied to this adding circuit 87, is applied to the loudspeaker 82 for reproduction of the center channel signal. The circuit 71 operates as follows.

In the case that the left-channel signal L and the right-channel signal R are music signals, the value of p will be substantially zero. This means that substantially the entire left-channel signal L and substantially the entire right-channel signal are reproduced via the loudspeakers 80 and 81, respectively. The loudspeaker 82 reproduces hardly any audio information. Thus, the music is reproduced fully in stereo. However, if the received signals L and R are speech signals, the probability indicated by the probability signal $V_P$ will be substantially equal to 1. This means that nearly all the audio information is reproduced via the loudspeaker 82. The loudspeakers 80 and 81 reproduce hardly any audio information. The division of the signals among the three loudspeakers 80, 82 and 83 has the advantage that music signals are reproduced in stereo and speech signals, for which the direction of the sound should correspond to the location of the speaker, are reproduced via the center-channel loudspeaker 82.

Figure 9:
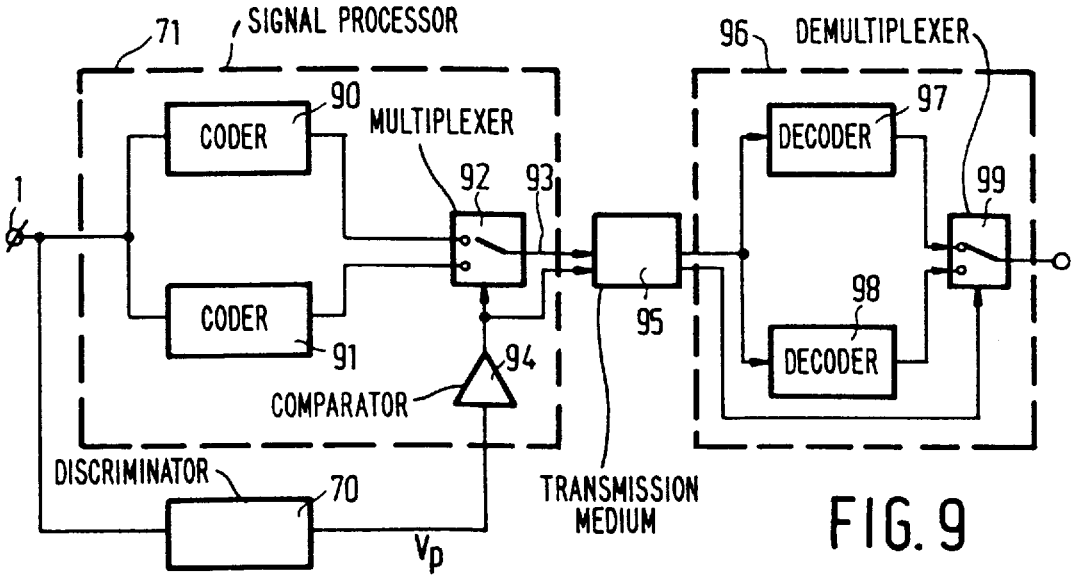

FIG. 9 shows another variant of the circuit 71. The circuit 71 comprises a first coding circuit 90 optimized for speech signal coding and a second coding circuit 91 optimized for music signal coding. The audio signal received via the input 1 is applied to an input of the coding circuit 90 and to an input of the coding circuit 91. The coding circuit 90 has an output coupled to an input of a two-channel multiplex circuit 92. The coding circuit 92 has an output coupled to another input of the two-channel multiplex circuit 92. The multiplex circuit 92 is controlled by a binary signal which has been derived, by means of a comparator 94, from the probability signal $V_P$ derived by the speech signal discriminator 70 from the signal received at the input 1. The circuit 71 operates as follows. Depending on the value of the applied probability signal $V_P$, the multiplex circuit 92 will connect either the output of the coding circuit 90 or the output of the coding circuit 91 to an output 93 of the multiplex circuit 92, so that on the output 93, a coded signal is available whose coding is adapted to the type of received signal (speech or music). The coded signal on the output 93 is applied to an input of a first decoding circuit 97 and to an input of a second decoding circuit 98 of a receiving circuit 96 via a signal transmission channel or medium 95. The first decoding circuit 97 is adapted to effect a decoding which is the inverse of the coding effected by the coding circuit 90. The second decoding circuit 98 is adapted to effect a decoding which is the inverse of the coding effected by the coding circuit 91. The outputs of the decoding circuits 97 and 98 are connected to inputs of a two-channel demultiplex circuit 99, which is controlled by the output signal of the comparator 94, which signal is also applied to the receiving circuit 96 via the signal transmission channel 95. This method of controlling the demultiplex circuit 99 ensures that the signal decoded by the appropriate decoding circuit is transferred to an output of this demultiplex circuit.

In addition to the versions of the circuit 71 described hereinbefore numerous other versions are possible. For example, the audio signal processing circuit may comprise an audio amplifier with a tone control or equalizer which is set in dependence upon the value of the probability signal. If the probability signal indicates a high probability that the received audio signal is a speech signal the tone control or equalizer is set to a position for optimum intelligibility of speech. In general, this means that the reproduced speech signal contains a comparatively small amount of bass tones. In the case of a low probability that the received audio signal is a speech signal, the tone control or equalizer is set to a position experienced as pleasing for music reproduction. This is generally a position in which the bass tones and, if desired, also the treble tones in the reproduced signal are boosted. In general, the probability signal has a value between a first extreme value indicating a speech signal with the maximum probability and a second extreme value indicating a music signal with the maximum probability. For values between these extreme values, it is preferred to select a tone control setting which is a combination of the desired setting for speech signals and the desired setting for music signals, the contributions of the two settings being dependent on the value of the probability signal.

In the case of audio devices having an additional bass loudspeaker (woofer) for enhancement of the reproduced music, it is advantageous to mute the additional bass loudspeaker in the case of speech signals in order to improve the intelligibility of speech.

In the case of picture display systems, such as television, in which picture-related sound is reproduced together with the display of pictures, it is advantageous to use the speech signal discrimination arrangement for changing over from stereo sound reproduction to mono reproduction if the associated audio signal is a speech signal. Indeed, when sound uttered by a speaker is reproduced, it is desirable that the position of the picture and of the sound source correspond to one another. For a similar purpose, the speech signal discrimination arrangement can also be used in an audio device comprising a circuit for spatial stereo. It is then also advantageous to disable the spatial stereo effect during the reproduction of speech signals.

The speech signal discrimination arrangement can also be used advantageously in an audio device for controlling the sound volume in dependence upon the probability indication signal. For example, in radio reception, it is desirable to reproduce speech signals with a higher volume in order to improve the intelligibility of the transmitted messages.

Moreover, the speech signal discrimination arrangement can be used advantageously in an apparatus for recording audio signals, recording being started and stopped depending on the value of the probability signal, for example, in the recording of music broadcasts which are regularly interrupted by speech or in the recording of speech on a dictation machine. With the last-mentioned use, it is advantageous to temporarily store the signals to be recorded in a buffer until the probability signal for this signal is available. Thus, it is possible to avoid that each time the first part of the signal to be recorded is missing on the record carrier.

I claims:

1. An audio device for processing a received audio signal, said audio device comprising:

a speech signal discrimination arrangement; and means for processing the received audio signal dependent on a probability indication signal generated by the speech signal discrimination arrangement;

said speech signal discrimination arrangement comprising:

an analyzing circuit for deriving an analysis signal indicative of a ratio between a signal power in a first portion of a frequency spectrum of the received audio signal and a signal power in a second portion of the frequency spectrum of the received audio signal;

a first signal pattern detector for detecting first and second signal patterns in the analysis signal, said first and second signal patterns each having a probability of occurrence in a speech signal that is greater than a probability of occurrence in another signal which is not a speech signal, said first signal patterns being a plurality of briefly succeeding rapid changes in the power ratio, each occurring within a given maximum time, and said second signal patterns being a temporary decrease of the power ratio below a given lower threshold for a given period of time; and estimator means for deriving the probability indication signal based on the detection of the first and second signal patterns.

2. A speech signal discrimination arrangement having an input for receiving an audio signal and an output for supplying a probability indication signal which is indicative of the probability that the audio signal received via the input is a speech signal, the arrangement comprising:

an analyzing circuit for deriving an analysis signal which is indicative of a ratio between a signal power in a first portion of a frequency spectrum of the received audio signal and a signal power in a second portion of the frequency spectrum of the received audio signal;

a first signal pattern detector for detecting first and second signal patterns in the analysis signal, said first and second signal patterns each having a probability of occurrence in a speech signal that is greater than a probability of occurrence in another signal which is not a speech signal, said first signal patterns being a plurality of briefly succeeding rapid changes in the power ratio, each occurring within a given maximum time, and said second signal patterns being a temporary decrease of the power ratio below a given lower threshold for a given period of time; and estimator means for deriving the probability indication signal based on the detection of the first and second signal patterns.

3. The arrangement as claimed claim 1, wherein for detecting said first signal patterns, the first signal pattern detector comprises:

means for detecting when, each time, a value of the analysis signal changes from a level above a given upper threshold to a level below a given lower threshold;

means for detecting a rate at which said changes have taken place; and means for detecting patterns in the occurrence of a series of successive changes having a rate that exceeds a given rate, a time interval between each change in said series of successive changes not exceeding said given maximum time.

4. The arrangement as claimed in claim 1, wherein for detecting said second signal patterns, the first signal pattern detector comprises:

means for detecting whether a value of said analysis signal is below said given lower threshold; and means for detecting whether a time interval, in which the value of said analysis signal is below said given lower threshold, lies between a given minimum amount of time and a given maximum amount of time.

5. The arrangement as claimed in claim 1, further comprising at least a second signal pattern detector for detecting third signal patterns different from said first and second signal patterns, said third signal patterns having a probability of occurrence in a speech signal that is less than a probability of occurrence in another signal, wherein said estimator means is adapted to derive the probability indication signal dependent upon the detection of said first, second and third signal patterns.

6. The arrangement as claimed in claim 5, wherein the second signal pattern detector is adapted to detect the third signal patterns in the analysis signal.

7. The arrangement as claimed claim 5, wherein for detecting the first signal patterns, the first signal pattern detector comprises:

means for detecting when, each time, a value of the analysis signal changes from a level above a given upper threshold to a level below said given lower threshold;

means for detecting a rate at which said changes have taken place; and means for detecting patterns in the occurrence of a series of successive changes having a rate that exceeds a given rate, a time interval between changes in the series not exceeding said given maximum time.

8. The arrangement as claimed in claim 5, wherein for detecting the second signal patterns, the first signal pattern detector comprises:

means for detecting whether a value of said analysis signal is below said given lower threshold; and means for detecting whether a time interval, in which the value of said analysis signal is below said given lower threshold, lies between a given minimum amount of time and a given maximum amount of time.

9. The arrangement as claimed claim 6, wherein for detecting the first signal patterns, the first signal pattern detector comprises:

means for detecting when, each time, a value of the analysis signal changes from a level above a given upper threshold to a level below said given lower threshold;

means for detecting a rate at which said changes have taken place; and means for detecting patterns in the occurrence of a series of successive changes having a rate that exceeds a given rate, a time interval between changes in the series not exceeding said given maximum time.

10. The arrangement as claimed in claim 6, wherein for detecting the second signal patterns, the first signal pattern detector comprises:

means for detecting whether a value of said analysis signal is below said given lower threshold; and means for detecting whether a time interval, in which the value of said analysis signal is below said given lower threshold, lies between a given minimum amount of time and a given maximum amount of time.

* * * * *